US006433316B1

(12) United States Patent
Sigety et al.

(10) Patent No.: US 6,433,316 B1
(45) Date of Patent: Aug. 13, 2002

(54) APPARATUS AND METHOD FOR HEATING A PRESSURIZED CONTAINER

(76) Inventors: James Sigety, 3856 Beattie Rd., Howell, MI (US) 48843; Kerry Paul Sigety, 400 Apple La., Webberville, MI (US) 48892

( * ) Notice: Subject to any disclaimer, the term of this patent is extended or adjusted under 35 U.S.C. 154(b) by 0 days.

(21) Appl. No.: 09/901,195

(22) Filed: Jul. 9, 2001

(51) Int. Cl.[7] ..... F27D 7/04

(52) U.S. Cl. ..... 219/433; 219/432; 219/400; 222/146.5

(58) Field of Search ..... 219/385, 386, 219/400, 429–433; 222/146.5

(56) References Cited

U.S. PATENT DOCUMENTS 2,453,425 A * 11/1948 Freed ..... 219/433
5,893,995 A * 4/1999 Waters ..... 219/400
6,005,227 A * 12/1999 Pappas ..... 219/400

FOREIGN PATENT DOCUMENTS

JP 11-108313 * 4/1999

* cited by examiner

*Primary Examiner*—Joseph Pelham
(74) *Attorney, Agent, or Firm*—Law Offices of John Chupa and Associates P.C.

(57) ABSTRACT

A heater assembly 10 which selectively heats a container holding pressurized gaseous matter. The heater assembly 10 includes a container holding portion 44 and a heater housing portion 42 which are separated by a divider wall 57 and a baffle 50, at least one aperture 60 and at least one selectively moveable member 52 which selectively and substantially covers the aperture 60 while member 52 is in a closed position 30. When in an open position, member 52 cooperatively couples with baffle 50 to form a heating passage 54, effective to indirectly heat a container 56.

15 Claims, 3 Drawing Sheets

APPARATUS AND METHOD FOR HEATING A PRESSURIZED CONTAINER

FIELD OF THE INVENTION

The present invention generally relates to an apparatus and a method for selectively heating a pressurized container, and more particularly, to an apparatus and a method which selectively and indirectly heats a pressurized storage container in a relatively safe and efficient manner.

BACKGROUND OF THE INVENTION

Containers are used in a wide variety of applications, to selectively store a wide variety of materials. For example and without limitation, one type of container is adapted to store and convey gaseous material, such as Nitrous Oxide to an automobile cylinder assembly, in order to increase the amount of torque produced by the engine.

The amount of Nitrous Oxide which may be dispensed during a certain amount of time is limited to the capacity and the amount of pressure under which the gas is stored. It has been found that heating such a pressurized container will conduct heat to the Nitrous Oxide contained therein, thereby causing the Nitrous Oxide to expand and increase the pressure within the storage container. Increasing the amount of pressure within the storage container, allows greater amounts Nitrous Oxide to be injected into the cylinder assembly during a certain time. For these reasons, automotive racing specialists, such as drag racing "pit crews" or mechanics, often heat the Nitrous Oxide storage containers prior to operatively disposing these containers within an automobile.

Previous methods for heating these pressurized containers include, but are not limited to, holding the flame of a torch (e.g., a propane torch) in direct contact with the pressurized container, placing the pressurized container near or in open flames (e.g., a camp fire), and wrapping the container with layers of tape and placing it in direct sunlight. Each of the aforementioned methods for heating a pressurized container are potentially dangerous and/or fatal, not only to the user of the methods, but to anyone who may be in close proximity to the pressurized container, as the unregulated amount of heat applied to the container may cause the container to explode.

There is therefore a need for a device or an assembly, which allows pressurized storage containers to be safely and efficiently heated in a manner which reduces the potential or likelihood of explosion. There is also a need for a method for heating a pressurized storage container without the use of a direct contact heat source, which overcomes some or all of the previously delineated drawbacks of prior pressurized storage container heating methods.

SUMMARY OF THE INVENTION

A first non-limiting advantage of the present invention is that it provides an apparatus and a method, which allows for the selective heating of a pressurized storage container in a manner which overcomes the previously delineated drawbacks of prior heating methodologies.

A second non-limiting advantage of the invention is that it provides an apparatus for heating a pressurized container, which allows for the selective and indirect heating of the pressurized storage container in a safe and efficient manner.

A third non-limiting advantage of the present invention is that it provides a method for safely and efficiently heating a pressurized container, such as a Nitrous oxide storage container.

According to a first aspect of the present invention, an apparatus is provided for use with a pressurized storage container of the type having a gaseous matter therein. The apparatus includes a generally hollow body, a heater, and at least one hinged member coupled to at least one aperture, into which a pressurized container may be deposited, thereby allowing the apparatus to selectively heat the pressurized container.

According to a second aspect of the present invention, an apparatus is provided comprising a generally hollow body having at least one aperture; a heater assembly which is disposed within the generally hollow body, and which generates heat; at least one member which is moveably coupled to the generally hollow body, and which is moveable from a first position in which the member closes the aperture to a second position; a baffle which is disposed within the generally hollow body, and which cooperates with the member when the member is in the second position, to form a heating passage; and a return passage is communicatively coupled to the heater assembly.

According to a third aspect of the present invention, a method of heating a container is provided, the method comprising the steps of: forming a container; providing a heater, a sensor, and an air intake device; placing the heater, the sensor, and the air intake device in the container; forming a heating passage within the container; forming a return passage, within the container, which is coupled to the heater; creating at least one aperture through the container; and selectively coupling at least one member to the aperture.

These and other features, aspects, and advantages of the present invention will become apparent from a reading of the following detailed description of the preferred embodiment of the invention and by reference to the following drawings.

DETAILED DESCRIPTION OF THE PREFERRED EMBODIMENT OF THE INVENTION

Figure 1:
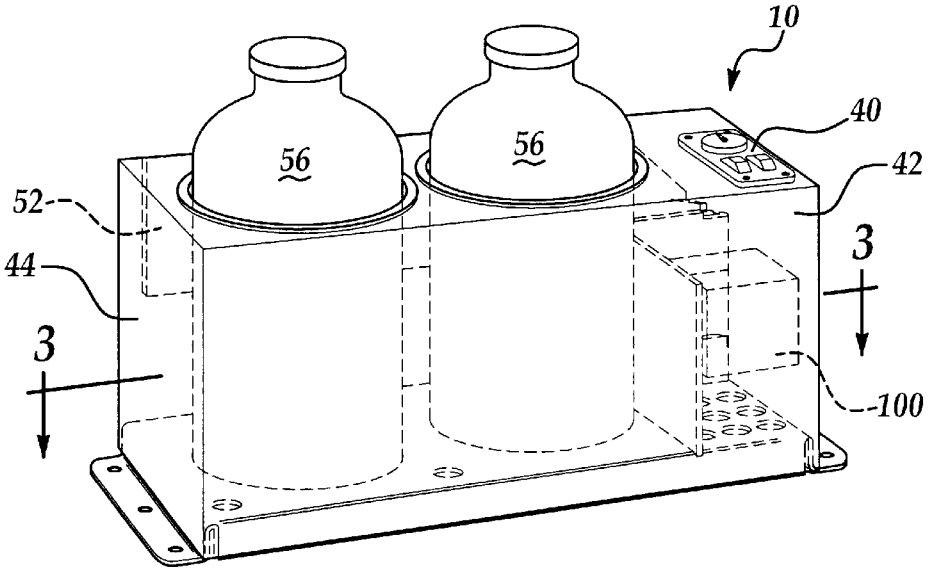
FIG. 1 is a perspective view of a heater, which is made in accordance with the teachings of the preferred embodiment of the invention in combination with certain containers1.

Referring now to FIGS. 1–5, there is shown a heater assembly 10, which is made in accordance with the teachings of the preferred embodiment of the invention. As shown, the heater assembly 10 includes a substantially rectangular and generally hollow body 70, comprising a top portion 12 having a switching assembly 40, a pair of substantially identical apertures 60, and selectively moveable members 52. Particularly, each selectively moveable member 52 is moveable from a first position 30, which selectively and substantially covers a unique one of the apertures 60, to a second position 32, which selectively cooperates with baffle 50 and forms heating passage 54, and is disposed within internal cavity 14 and directly below aperture 60. Generally hollow body 70 further comprises of wall portions 84 through 87, which cooperatively form internal cavity 14. While the heater assembly 10 disclosed above includes a pair of generally round apertures 60 and members 52, the number and shape of apertures 60 and members 52 are for exemplary purposes only, and other quantities and shapes are intended Heater assembly 10 further comprises of base section 72. Base section 72, having a top portion 73, comprises of a bottle retention aperture(s) 62, a generally serpentine shaped divider wall 57, which substantially divides internal cavity 14 into the respective portions or "halves" 42, 44, and a baffle 50, which substantially directs heated air from heater housing portion 42 to container holding portion 44. Base section 72 further comprises of base portions 74 through 77, return aperture 53 which effectively allows cooler air to pass into return passage 64, and heater aperture(s) 55, which effectively allow cooler air to pass into the heater housing portion 42.

Figure 2:
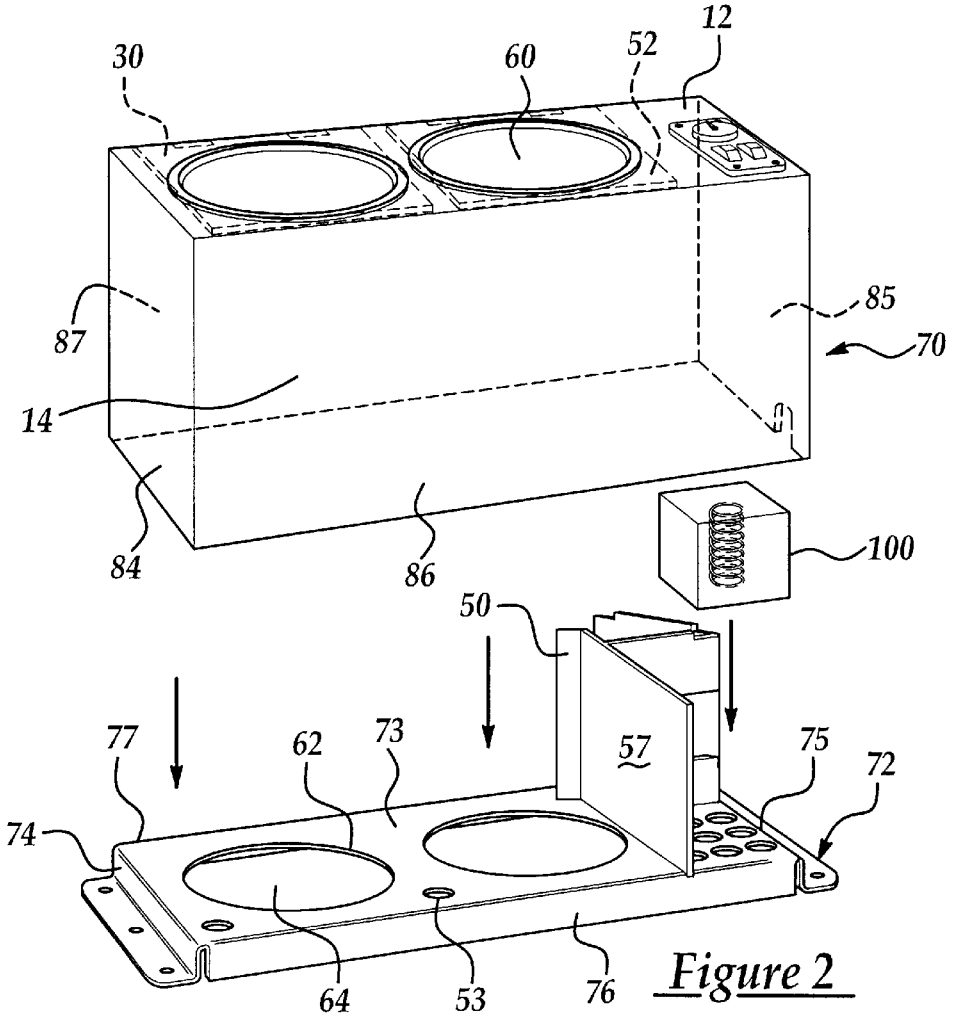
FIG. 2 is a perspective unassembled view of the heater body and heater base which are shown in FIG. 1.

As best shown in FIG. 2, wall portions 84, 85 mate with base portions 74, 75 and wall portions 86, 87 mate with base portions 76, 77 effective to fixedly couple generally hollow body 70 to base 72. Internal cavity 14 and divider wall 57 cooperatively form the heater housing portion 42 and container holding portion 44. A unique one of the aperture(s) 60 cooperatively functions with a unique one of the selectively movable members 52 and bottle retention aperture 62, effective to allow a container 56 to be held securely in place, furthermore, when container 56 is deposited through aperture 60 and into heater assembly 10, selectively movable member 52 is moved into position 32 (i.e., member 52 cooperates with baffle 50 to form heating passage 54). When selectively moveable member 52 is in position 32, selectively movable member 52 and baffle 50 cooperatively form heating passage 54, which permits air to be substantially channeled from heater housing portion 42 to container holding portion 44. Additionally, at least one return aperture 53 cooperatively functions with return passage 64 and with heater aperture 55, effective to substantially channel air from container holding portion 44 into heater housing portion 42.

Figure 5:
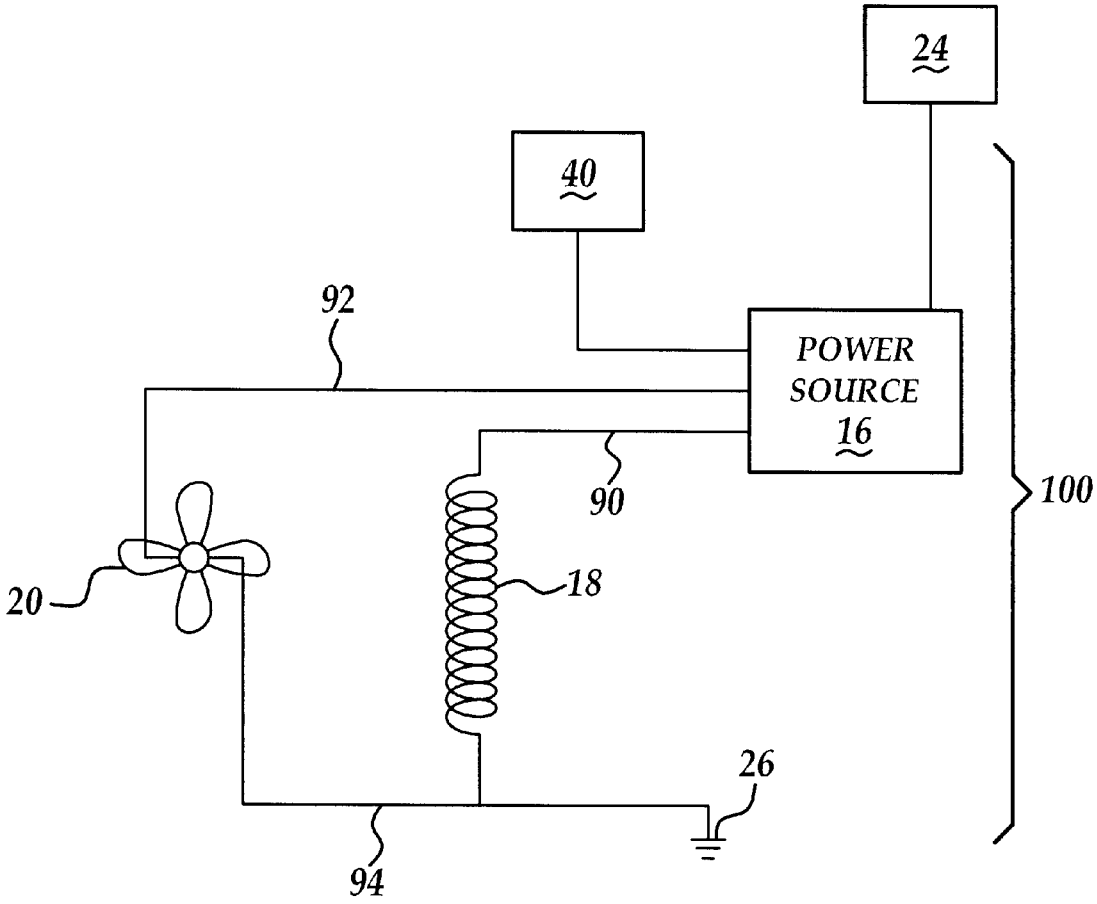
FIG. 5 is an electrical diagram of the heating element which is disposed within the heater assembly shown in FIGS. 1–4.

Referring now to FIG. 5, the heating element 100 is comprised of a power source 16, selectively moveable fan 20, and electric heater coils 18. Heating element 100 is further coupled to at least one heat sensor 24 which is operatively disposed within cavity 14 and is effective to measure the internal temperature of heating assembly 10.

Power source 16 is communicatively coupled to thermostat 47 and heat sensor 24, effective to measure and maintain a pre-determined temperature inside cavity 14 of heater assembly 10 and to selectively terminate electrical power when the pre-determined temperature has been exceeded, power source 16 is further selectively and communicatively coupled to electric heater coils 18 by electrical bus 90. Heater coil 18 is further coupled via bus 94 to a electrical ground potential 26, effective to cause heater coils 18 to generate heat or "heat up" when an electric current is sourced to coils 18. Power source 16 is still further coupled to fan 20 via bus 92. Fan 20 is further coupled via bus 94 to electrical ground potential 26, effective to cause fan 20 to displace a volume of air when power source 16 transmits an electric current to the fan 20. Heating element 100 is disposed in heater housing portion 42, and is selectively and communicatively coupled to switching assembly 40, as discussed further below.

Heater assembly 10 further includes switching assembly 40. Switching assembly 40 includes, in one non-limiting embodiment, a first "on/off" switch 41, and a second "on/off" switch 43 which controls the operation of heater coils 18 and fan 20. Particularly, switch 41 and switch 43 respectively allow a user to selectively activate and deactivate heater coils 18 and selectively moveable air intake device or fan 20. Switching assembly 40 further includes a thermostat or dial 47 (e.g., a variable potentiometer), which allows a user to selectively control the temperature of heater coils 18, for example and without limitation, a user can selectively raise the temperature of heater coils 18 by turning dial 47 clockwise, or lower the temperature of heater coils 18 by turning dial 47 counter-clockwise. In other non-limiting embodiments, switching assembly 40 may further comprise a display showing the temperature within cavity 14 and/or a controller which may be selectively programmable to store and run certain pre-programmed heating routines.

In operation, heating element 100 is activated and controlled by switching assembly 40. When heating element 100 is activated, power source 16 selectively energizes thermostat 47 and heat sensor 24 and compares the desired temperature of thermostat 47 with the current internal temperature which is measured by heat sensor 24. If the measured temperature is less than the desired temperature, power source 16 further energizes selectively moveable fan 20 and heater coils 18. Heater coils 18 heat up and selectively moveable fan 20 forces air over and through heater coils 18, effective to substantially heat the air.

Figure 3:
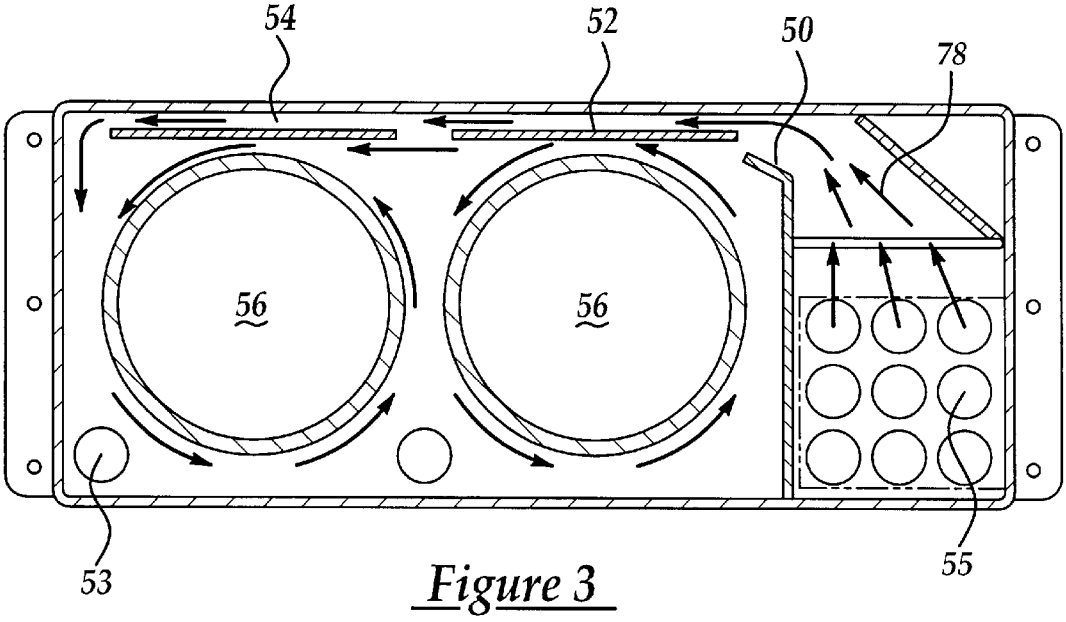
FIG. 3 is a sectional top view of the heater as shown in FIGS. 1 and 2.

When a container 56 is placed within heater assembly 10 through aperture 60, selectively moveable member 52 is in position 32 ( i.e., member 52 cooperates with baffle 50 to form heating passage 54). As best shown in FIG. 3, the energized air 78 is then pushed through the baffle 50 in the direction of arrows 78, through heating passage 54, effective to indirectly channel the heated air past the container 56, and circulated around the container 56. The formation of heating passage 54 and the subsequent channeling of heated air through the heating passage 54 permits the heating assembly 10 to desirably heat the container 56 without directly applying a source of heat to the container 56.

Figure 4:
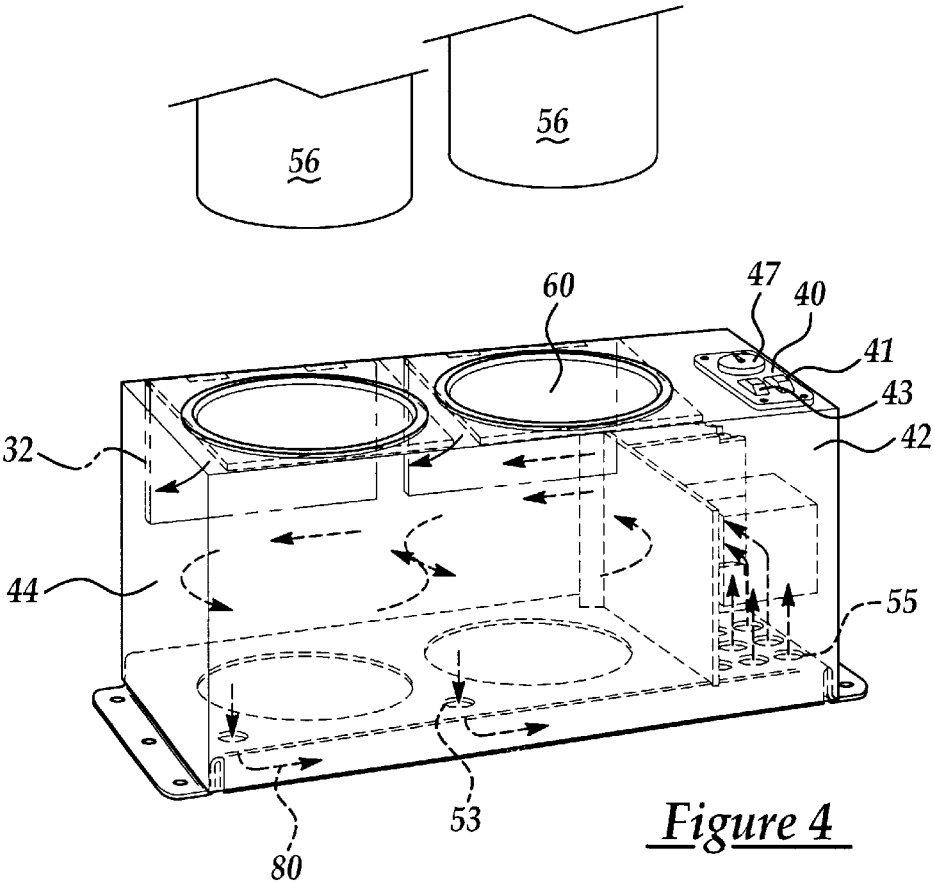
FIG. 4 is a very similar perspective view of the heater shown in FIGS. 1–3, but without the containers being operatively disposed within the assembly, and shows the selectively movable members in a closed position.

As best shown in FIG. 4, when the heated air cools, the cooler air settles toward base portion 72 and at least one return aperture 53 accepts the cooled air into the return passage 64. The force of fan 20 causes the cooled air to travel in the direction of arrows 80 through the return passage 64, and directs the cooled air through return apertures 55, back into the heater coils 18, and there the air is re-heated and is re-circulated throughout heater assembly 10, effective to substantially maintain a pre-determined temperature within the heater assembly 10. Once the pre-determined temperature has been achieved, power source 16 will selectively terminate power to heating element 100.

It should be understood that this invention is not limited to the exact construction or embodiments listed and described, but that various changes may be made without departing from the spirit and scope of the invention.

What is claimed is:

1. An apparatus for heating a pressurized container, said apparatus comprising a heater housing portion having a selectively energizable heater assembly, a fan, and a thermostat which selectively de-energizes said heater assembly; said apparatus further including a container holding portion which is coupled to said heater housing portion and which is adapted to selectively receive said pressurized container, said container holding portion having at least one aperture and at least one door assembly which selectively and movably covers said at least one aperture, said apparatus further including a heat sensor; and a baffle, wherein said at least one door assembly, when opened, cooperates with said baffle to create a channel.

2. A heating apparatus comprising a generally hollow body having at least one aperture; a heater assembly which is disposed within said generally hollow body, and which generates heat; at least one member which is moveably coupled to said generally hollow body, and which is moveable from a first position in which said at least one member substantially covers said at least one aperture to a second position; a baffle which is disposed within said generally hollow body, and which cooperates with said member when said member is in said second position, to form a heating passage; and a return passage, which is communicatively coupled to said heater assembly.

3. The heating apparatus of claim 2, wherein said at least one member comprises at least one hinged door member.

4. The heating apparatus of claim 2, wherein said heater assembly is further communicatively coupled with at least one temperature sensor, said at least one temperature sensor cooperates with said heater assembly to selectively manipulate and maintain air temperature within said generally hollow body.

5. The heating apparatus of claim 4, wherein said heater assembly is further communicatively coupled to an air intake device, effective to move lower temperature air from said return passage into said heater assembly.

6. The heating apparatus of claim 2, wherein said heating apparatus further comprises at least one retention member, which cooperates with said at least one aperture to hold a container that is placed within said heating apparatus.

7. The heating apparatus of claim 2, wherein said generally hollow body is separated by a wall member into a heater portion and a container housing portion; said heating passage, said return passage, said at least one aperture, and said baffle are communicatively coupled to effectively and indirectly heat a container.

8. A method of heating a container, said method comprising the steps of:

forming a heating assembly housing;

providing a heater, a sensor, and an air intake device and placing said heater, sensor, and air intake device into said heating assembly housing;

forming a return passage, within said heating assembly housing, and coupling said return passage to said heater;

creating at least one aperture through said heating assembly housing;

coupling at least one movable member to said heating assembly housing, said at least one movable member being effective to cover said at least one aperture; and forming a heating passage within said heating assembly housing by moving said at least one selectively movable member against a wall of said heating assembly housing.

9. The method of claim 8 wherein said step of forming a heating assembly housing, further comprises the steps of:

forming a heater housing portion;

forming a container holding portion; and forming a baffle between said heater housing portion and said container holding portion.

10. The method of claim 8 wherein said heater and said sensor are communicatively coupled, effective to regulate air temperature within said heating assembly housing.

11. The method of claim 8 wherein said heater is coupled to said air intake device, effective to move heated air through said heating passage and to move cooled air through said return passage into said heater.

12. The method of claim 9 wherein said at least one selectively movable member, cooperates with said baffle to further form said heating passage, effective to prevent direct heat from directly contacting a container disposed within said heating assembly housing.

13. The method of claim 8 wherein said step of creating at least one aperture through said heating assembly housing further comprises the step of:

forming at least one retention device, effective to maintain a container in a certain position.

14. The method of claim 10 wherein said heater and said sensor are further coupled to a switching assembly.

15. The method of claim 14 wherein said switching assembly further comprises a temperature control dial.

* * * * *